United States Patent [19]

Kosmas et al.

[11] Patent Number: 4,459,703

[45] Date of Patent: Jul. 17, 1984

[54] SEAT PROTECTION DEVICE FOR SKIERS

[76] Inventors: Paulette U. Kosmas, 6376 Lake Shore Dr., San Diego, Calif. 92119; Donna M. Lawlor, Park West Condo B-1, Snyderville, Utah 84060

[21] Appl. No.: 460,373

[22] Filed: Jan. 24, 1983

[51] Int. Cl.[3] ..... A41B 13/10

[52] U.S. Cl. ..... 2/48; 2/338

[58] Field of Search ..... 2/48, 46, 49 A, 49 R, 2/50, 47, 51, 338, 247, 250; 297/4

[56] References Cited

U.S. PATENT DOCUMENTS

| | | | |
|---|---|---|---|
| D. 238,725 | 2/1976 | Zerobnick | D2/381 |
| 367,996 | 8/1887 | Nathan . | |
| 2,428,477 | 10/1947 | Thompson | 2/247 |
| 2,437,223 | 12/1948 | Dutrow | 2/94 |
| 2,537,701 | 1/1951 | Previdi | 2/94 |
| 2,568,544 | 7/1949 | Head | 2/46 |
| 3,062,580 | 6/1960 | Jasmin, Jr. | 297/4 |
| 3,708,799 | 1/1973 | Smithdeal | 2/46 |
| 4,079,871 | 3/1978 | Sica | 224/5 D |
| 4,138,745 | 2/1979 | Greenspan | 2/247 |
| 4,218,781 | 8/1980 | Lieberman | 2/247 |

*Primary Examiner*—Doris L. Troutman

*Attorney, Agent, or Firm*—Brown & Martin

[57] ABSTRACT

A seat protection device for skiers includes a belt with a compact container at the back of the belt which contains a seat protection flap fastened at one end to the inside of the container. The flap is folded or rolled into the stored position within the container. An opening provides access to the free end of the seat protecting flap whereby the flap can be unfolded or unrolled to cover the skier's seat. When the skier finishes using the seat protection flap, it is rolled or folded into the stored position back within the container.

8 Claims, 5 Drawing Figures

SEAT PROTECTION DEVICE FOR SKIERS

BACKGROUND OF THE INVENTION

The present invention relates to a seat protection device that is stored in a container affixed to a belt worn around the waist of a skier.

In cold and/or wet conditions, the chairs of the ski lift can be cold and damp. The body warmth of the skier tends to create moisture on the chair seats even when the weather is relatively dry. Chair seat covers can be carried in the skier's pocket, but they cannot be applied while mounting the chair. If the skier maneuvers to apply the cover while he or she is in the chair and the chair is moving, this creates a dangerous condition in that the skier could fall from a substantial height.

A device is needed which is not bulky and which can be conveniently stored without detracting from the skier's appearance. A bulky device impedes the skier's movement. Further, skiers are very conscious of their appearance and spend a substantial amount of money on attractive ski outfits.

SUMMARY

The present invention provides a seat protection device for skiers that is compact and attractive and which does not detract from the skier's appearance. It includes belt means with flap container means at the back. The flap container means is small and extends along the belt to hold the seat protection flap in a rolled or folded compact condition. Access means is provided in the flap container means so that the free end of the seat protection flap can easily and conventiently be moved out of the container means to the seat protection position.

DESCRIPTION OF THE INVENTION

Figure 3:
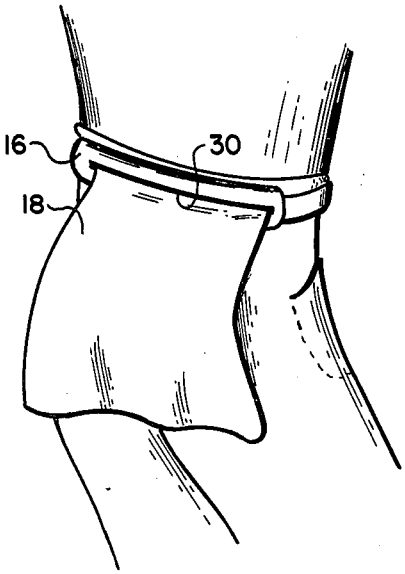
FIG. 3 is a perspective view showing the seat protection device of the present invention in the operative position with the flap extending out of the flap container.
Figure 1:
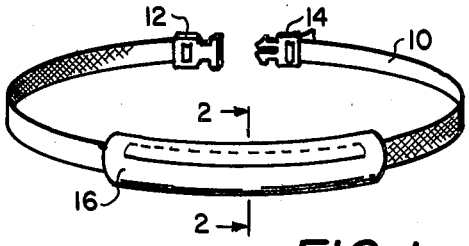
FIG. 1 is a perspective view showing the seat protection device of the present invention with the seat protection flap in the stored position.

The seat protection device includes a belt 10 having fastening means on its ends such as the quick connect device 12–14. A container 16 made of lightweight reinforced material such as taffeta or rip stock treated with waterproof material is affixed to the belt 10. The container 16 can be slotted to slide on the belt for position adjustment or it can be permanently affixed to the belt by stitching or bonding.

A seat protection flap 18 of lightweight waterproof material such as treated taffeta or rip stock is connected to the container at 20 and is folded in pleats within the container 16. The container 16 includes an overlying cover portion 22. The cover portion 22 is held closed by Velcro strips 24 and 26. The device is compact and attractive.

When the skier desires to use the seat protection flap, he or she merely releases the Velcro connection 24-26, grasps the free end 28 of the seat protection flap 18 and pulls it through the opening 30 in the container 16. The flap 18 tapers outwardly and downwardly and extends over the seat of the skier. This protects the seat from moisture and the cold surface of the ski lift chair or from other surfaces such as outdoor seats. In use, the flap 18 provides a skirt like appearance and does not detract from the skiing apparel.

A configuration which has been found successful embodies a container that is thirteen inches long and two inches in diameter. The seat protection flap is twenty-three inches long, thirteen inches wide where it connects to the container, and twenty-one inches wide at its free end. The belt is one and one-quarter inches wide.

When the skier wishes to return the seat protection flap 18 to the stored condition, he or she merely folds it into pleats or rolls it and places it inside the container 16. The Velcro fastening portions 24 and 26 are then engaged.

Figure 4:
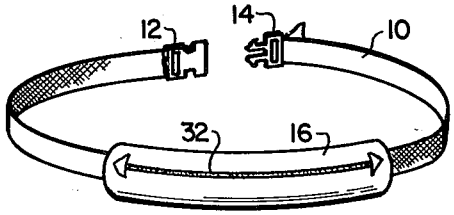
FIG. 4 discloses an arrangement wherein the access to the inside of the flap container is provided by a slit.
Figure 2:
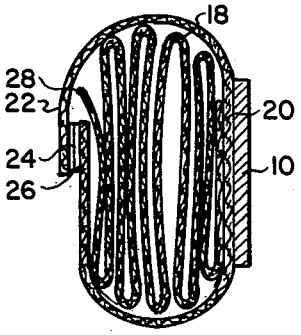
FIG. 2 is a sectional view taken along line 2-2 of FIG. 1.
Figure 5:
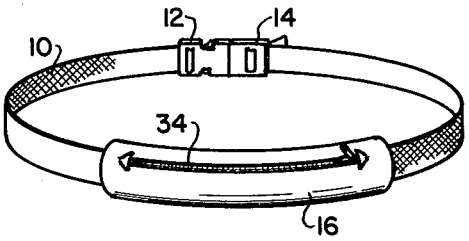
FIG. 5 discloses an arrangement wherein the access to the inside of the flap container is provided by an opening with a zipper.

Access to the container 16 can also be provided by other means such as the slot 32 shown in FIG. 4 or the zippered opening 34 shown in FIG. 5.

The device of the present invention is simple in construction and can be readily produced at low cost. It is easy to use and attractive in appearance. Its light weight and lack of bulk make it appealing to the skier.

Having thus described our invention, we claim:

1. A seat protective device for skiers comprising:

a belt for fastening around the waist of a skier;

an elongated seat flap container positionable along the outer surface of said belt;

a seat protection flap housable within said container and connected to the interior thereof;

said seat flap being of a width and length to cover seat of a skier;

said container having a length along said belt for accommodating said flap width;

openable access means in said container for allowing the unconnected portion of said flap to be removable from within said container to cover the seat of a skier and returnable to within said container when not in use.

2. A seat protection device for skiers according to claim 1 wherein:

said container means is fixedly attached to said belt to be positioned above the seat of a skier.

3. A seat protection device for skiers according to claim 1 wherein:

said seat flap is foldable or rollable for storage within said container.

4. A seat protection device for skiers according to claim 1 wherein said openable access means comprises:

a slit in said container means extending substantially the length thereof for permitting full width removal and return of said flap from within said container; and means for establishing the moisture-proof closure of said slit.

5. A seat protection device for skiers according to claim 4 wherein said closure means comprises:

an overlapping cover portion formed in said container for closing said slit when said cover portion is placed in a closed position.

6. A seat protection device for skiers according to claim 1 wherein said container and said flap are formed of supple lightweight waterproof material.

7. A seat protection device for skiers according to claim 1 wherein:

said flap is a continuous planner element tapering outwardly and downwardly from within said container to extend over the seat of a skier.

8. A seat protection device for skiers according to claim 1 wherein said belt is provided with a quick release fastening means.

* * * * *